United States Patent [19]

Fleming, Jr. et al.

[11] 4,175,060

[45] Nov. 20, 1979

[54] COMPOSITION AND PROCESSING PROCEDURE FOR MAKING THERMISTORS

[75] Inventors: James W. Fleming, Jr., Fanwood; Henry M. O'Bryan, Jr., Plainfield; John Thomson, Jr., Spring Lake, all of N.J.

[73] Assignee: Bell Telephone Laboratories, Incorporated, Murray Hill, N.J.

[21] Appl. No.: 854,813

[22] Filed: Nov. 25, 1977

[51] Int. Cl.[2] ..... H01B 1/08

[52] U.S. Cl. ..... 252/518; 252/520; 264/61

[58] Field of Search ..... 252/520, 521, 518; 106/73.2, 73.31; 264/61

[56] References Cited

U.S. PATENT DOCUMENTS

| | | | |
|---|---|---|---|
| 3,351,568 | 11/1967 | Waseleski, Jr. et al. | 252/520 |
| 3,444,101 | 5/1969 | Viernickel | 106/73.2 X |
| 3,586,642 | 6/1971 | Matsuo et al. | 252/520 |
| 4,014,822 | 3/1977 | Fujikawa | 252/520 |
| 4,061,583 | 12/1977 | Murata et al. | 252/521 |

*Primary Examiner*—Benjamin R. Padgett
*Assistant Examiner*—E. Suzanne Parr
*Attorney, Agent, or Firm*—Walter G. Nilsen

[57] ABSTRACT

A ceramic composition and processing procedure is described which is useful in electric and electronic devices such as thermistors. The ceramic composition, which may be described as a semiconducting barium titanate, exhibits a large positive temperature coefficient of resistance. Advantages are ease and convenience of fabrication with lower sintering temperature than conventional processing and use of an air atmosphere instead of nitrogen or oxygen atmospheres. This facilitates batch processing and permits convenient sintering in a continuous kiln.

6 Claims, 2 Drawing Figures

COMPOSITION AND PROCESSING PROCEDURE FOR MAKING THERMISTORS

BACKGROUND OF THE INVENTION

1. Field of the Invention

The invention relates to an electronic device and process for making such a device.

2. Description of the Prior Art

Electric current limiting devices such as thermistors are extensively used in electronic equipment. Such devices require ceramic material with large positive temperature coefficients of resistance. Typically the resistance increase by more than three orders of magnitude in the temperature range between 0 and 200 degrees C. Various ceramic materials exhibit large positive coefficients of resistance including semiconducting barium titanate. A typical composition presently used is $Ba_{0.99}$-$_3La_{0.007}Ti_{0.99}O_3$. Such compositions require high sintering temperatures and complicated atmosphere control during processing. Although such ceramics work perfectly well, more convenient procedures for making the ceramic are highly desirable so as to reduce production costs and permit more rapid and convenient production of the ceramic material.

SUMMARY OF THE INVENTION

The invention is a device and process for making such devices. The device contains at least one element (called herein a positive resistance element) which increases resistance significantly with increasing temperature. The magnitude of the resistivity increase varies with the application. Generally, an increase of at least two orders of magnitude in the temperature range from 0 to 200 degrees C. is required for many applications. For other applications greater increases in resistivity, up to three, four or five orders of magnitude are desirable. This element is made from a ceramic with a particular composition and the ceramic is prepared by a particular process. The advantages of this composition and this process are that air firing is used throughout the processing and the sintering temperature is comparatively low. The composition involves semiconducting $BaTiO_3$ with a suitable donor ion to make barium titanate semiconducting. Generally, any ion with a plus three valance which will substitute for the lattice ion is suitable. Nominal formula for the doped barium titanate is $Ba_{1-x}M_xTi_yO_3$. A large variety of donor (M) ions are used including rare earth ions (atomic numbers 57–71) and other well-known donor ions such as yttrium, antimony, niobium, etc. Lanthanum is preferred because of stability (particularly valance stability) availability and low cost. Hereafter, for convenience, the invention is illustrated in terms of lanthanum as the donor ion, but it should be understood that other suitable donor ions may be used. The composition is a lanthanum doped barium titanate with nominal formula $Ba_{1-x}La_xTi_yO_3$ with $x=0.004\pm0.0004$ and $y=1.0075\pm0.0025$. To this nominal formula is added before final sintering $0.2\pm0.05$ weight percent $Al_2O_3$ and preferably $0.02\pm0.01$ weight percent $SiO_2$. Slight excess of $TiO_2$ as well as the addition of $Al_2O_3$ are most significant. A significant advantage of this composition is the ease and convenience of processing to achieve the desired high positive temperature coefficient of resistance. Air firing is used throughout. Comparatively low firing temperatures ($1350\pm50$ degrees C.) are used. Also, firing conditions, including rate of cooling and atmosphere during firing and cooling are not very critical. This permits easier fabrication at lower cost and also permits the use of continuous kiln processing as well as batch processing.

DETAILED DESCRIPTION

Figure 1:
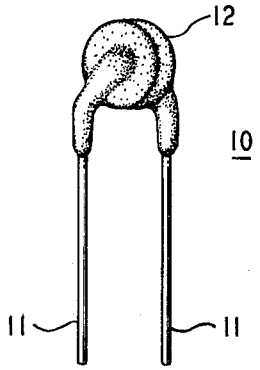
FIG. 1 shows a top view of an electrical element with positive temperature coefficient of resistance, generally called a thermistor.

Composition requirements are particularly important because it results in a high positive temperature coefficient of resistance and permits the simpler processing procedure outlined below. In general terms, the composition is a barium titanate modified to be semiconducting by the addition of a suitable donor (rare earth ions, yttrium, antimony, niobium, etc.) and modified as to grain structure by the addition of $Al_2O_3$ alone or preferably also $SiO_2$. Using lanthanum as the donor ion, the composition has the nominal formula $Ba_{1-x}La_xTi_yO_3$ with $x=0.004$ and $y=1.0075$. Preferably, deviations from these values should not be greater than $\pm0.0001$ for x and $\pm0.0005$ for y but deviations up to $\pm0.0004$ for x and $\pm0.0025$ for y yield useful and acceptable results. To this composition is added before final sintering $0.2\pm0.05$ weight percent $Al_2O_3$ and preferably $0.02\pm0.01$ weight percent $SiO_2$. The $Al_2O_3$ and $SiO_2$ may be added in any way which produces reasonable uniformity in the mixture. Simple addition of the $Al_2O_3$ and/or $SiO_2$ and extended mixing, say by ball milling, yields satisfactory results.

The processing procedure is distinguished by relative convenience in firing atmosphere, firing temperature and temperature versus time profile during processing. Initial steps in the process involve making the lanthanum doped barium titanate. Various procedures for producing the semiconducting barium titanate may be used. Generally, various substances which yield the barium titanate (a barium compound, a titanium compound and a doping compound in the correct portions to yield semiconducting barium titanate) are mixed together and heated to yield the modified barium titanate. Particularly convenient are barium carbonate and titanium dioxide (anatase). These materials are mixed together to make a reasonably uniform mixture. A convenient procedure is to add the components to deionized water in a suitable container and use an homogenizing blender. Dopants such as lanthanum may be added in various ways. The oxide or other lanthanum compound may be added directly, or appropriate amounts of an aqueous solution of lanthanum nitrate may be added and the lanthanum precipitated by addition of an alkaline agent such as ammonium hydroxide. This precipitation procedure has the advantage of adding the lanthanum more uniformly throughout the barium and titanium compounds. At the conclusion of mixing, the powder mixture is separated from the water, generally by filtration, and dried. It is advantageous to screen the resulting filter cake through a mesh sieve (for example, an 18 mesh stainless steel sieve). The resulting mixture is then calcined at temperatures above 1,000 degrees C. for at least one hour in an air atmosphere. Times over 10 hours although not detrimental are wasteful of time. It is preferable that the calcining take place at a temperature of 1,150 degrees C. $\pm25$ degrees C. for approximately six hours in an air atmosphere. The resulting powder which is largely lanthanum doped barium titanate is again mixed, generally by ball milling.

Much of the advantageous aspects of the invention depend on the discovery that the addition of significant amounts of aluminum oxide and optionally silicon dioxide, permit fabrication of material with proper room temperature and resistivity versus temperature characteristics without use of atmospheres other than air and without an involved cooling program. Room temperature resistivity should generally be between 10 and 200 ohm-cm, preferably 50–100 ohm-cm.

The $Al_2O_3$ and preferably $SiO_2$ are now added and the resulting material mixed so as to achieve reasonably uniform distribution of the components and small particle size. Ball milling is a convenient way of achieving this result. Direct addition of the aluminum oxide and silicon dioxide is preferred over impurity pickup from the ball milling because of better control over the amount of $Al_2O_3$ and $SiO_2$ present in the powder. The actual ceramic is made by first pressing this powder into the desired shape and then sintering. Sintering should take place in the temperature range between 1,300 degrees C. and 1,400 degrees C. for approximately one to four hours, the lower temperatures generally requiring longer time and the higher temperatures shorter times. Preferred conditions and 1,350 degrees C. ±10 degrees C. and a time of two hours ±10 minutes. This procedure is carried out in air. The temperature range and time limitations are made to insure sufficient formation of liquid between grain boundaries without affecting too much grain growth. Cooling should take place at a specific rate within the range of 50–200 degrees C. per hour. The preferred cooling rate is between 70 and 100 degrees C. per hour. Again, the procedure is carried out in air. More rapid cooling is then set forth in the range above which leads to an unsatisfactorily small change of resistance with temperature. Slower cooling is then set forth in the range above which leads to an unusually high room temperature resistance.

FIG. 1 shows an electronic device generally called a thermistor 10 with electrical leads 11 leading to a ceramic 12 made in accordance with the invention.

Figure 2:
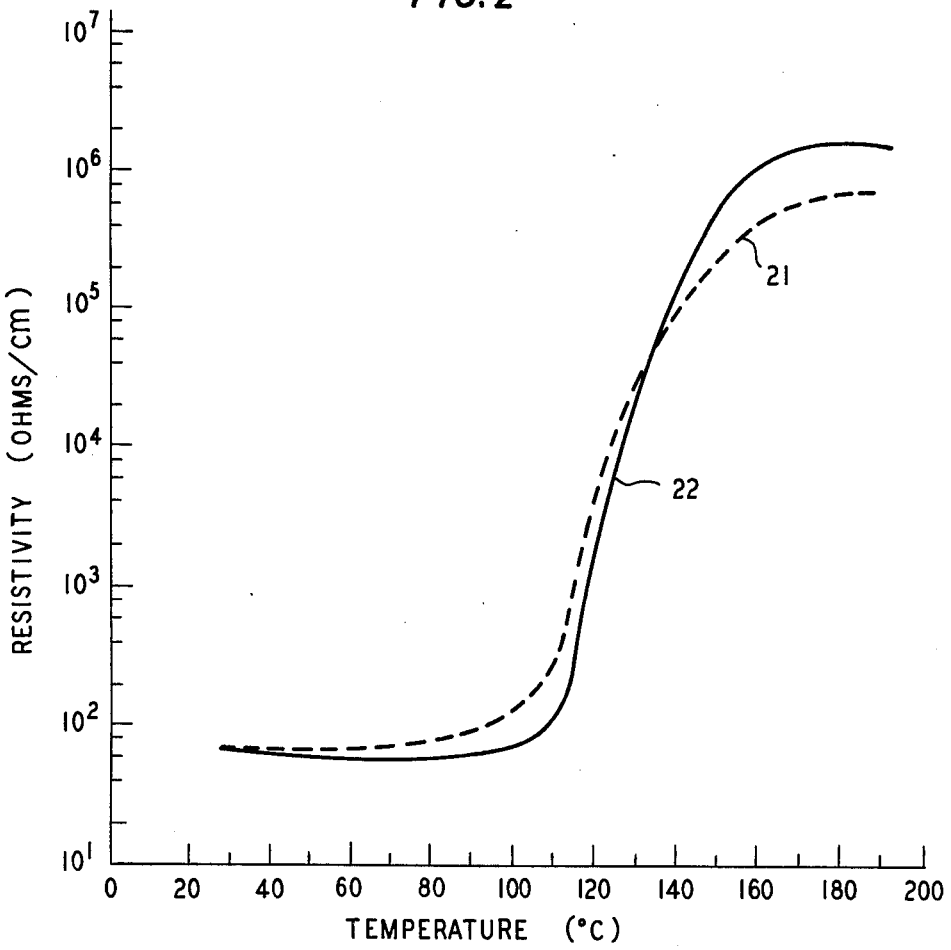
FIG. 2 shows in graphic form, data on the resistivity of the thermistor material as a function of temperature.

FIG. 2 shows in graphic form the resistance versus temperature characteristics of ceramic material made by conventional means 21 and in accordance with the invention 22. It is seen from this data that ceramic made in accordance with the simplified procedure outlined above has characteristics as good, if not better than ceramic material made by the more complicated procedure used in the past.

What is claimed is:

1. A process for making an electrical device comprising ceramic material with a positive temperature coefficient of resistance, said ceramic material comprising a first material and a second material, said first material comprising a substance with nominal formula $Ba_{1-x}M_xTi_yO_3$ with $x=0.004\pm0.0004$, $y=1.0075\pm0.0025$ and M represents lanthanum doping ion which renders barium titanate semiconducting where said first material is made by mixing together barium, titanium and lanthanum compounds which yield semiconducting barium titanate on heating in which the lanthanum compound is added by precipitation from an aqueous solution of a soluble lanthanum salt and heating said mixture to a temperature of 1150 degrees C. ±25 degrees C. for approximately six hours in an air atmosphere and said second material comprising 0.2±0.05 weight percent $Al_2O_3$ said process comprising heating a mixture of the first material and the second material to a temperature of from 1300 to 1400 degrees C. for a time between one to four hours in air and cooling in air at a rate between 50 and 200 degrees C. per hour.

2. The process of claim 1 in which the ceramic is cooled in air at a rate between 70 and 100 degrees C. per hour.

3. The process of claim 1 in which the mixture is heated to a temperature of 1350 degrees C. ±10 degrees C. for a time of two hours ±10 minutes in air.

4. The process of claim 1 in which the second material comprises in addition to 0.2±0.05 weight percent $Al_2O_3$, a quantity of 0.02±0.01 weight percent $SiO_2$.

5. The process of claim 1 in which the lanthanum compound is lanthanum nitrate.

6. The process of claim 1 in which the barium compound is barium carbonate and the titanium compound is the anatase form of titanium dioxide.

* * * * *